US007941995B2

(12) United States Patent
Goss et al.

(10) Patent No.: US 7,941,995 B2
(45) Date of Patent: May 17, 2011

(54) EXHAUST AFTERTREATMENT SYSTEM WITH COMPLIANTLY COUPLED SECTIONS

(75) Inventors: James R. Goss, Madison, WI (US); Randolph G. Zoran, McFarland, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 896 days.

(21) Appl. No.: 11/865,834

(22) Filed: Oct. 2, 2007

(65) Prior Publication Data

US 2009/0084094 A1 Apr. 2, 2009

(51) Int. Cl.

| | |
|---|---|
| ***F01N 3/00*** | (2006.01) |
| ***F01N 3/10*** | (2006.01) |
| ***F01N 3/02*** | (2006.01) |
| ***F01N 1/00*** | (2006.01) |

(52) U.S. Cl. ..... 60/322; 60/295; 60/301; 60/303; 60/311

(58) Field of Classification Search ..... 60/286, 60/295, 297, 301, 303, 311, 322, 324
See application file for complete search history.

(56) References Cited

U.S. PATENT DOCUMENTS

| | | | | |
|---|---|---|---|---|
| 3,492,030 | A * | 1/1970 | Lund et al. | 285/300 |
| 5,167,430 | A * | 12/1992 | Bainbridge | 285/53 |
| 5,318,329 | A * | 6/1994 | Suzuki et al. | 285/49 |
| 5,437,479 | A * | 8/1995 | Hartling et al. | 285/49 |
| 6,109,661 | A * | 8/2000 | Cwik et al. | 285/45 |
| 6,203,770 | B1 * | 3/2001 | Peter-Hoblyn et al. | 423/212 |
| 6,296,282 | B1 * | 10/2001 | Burkhardt et al. | 285/49 |
| 6,449,947 | B1 * | 9/2002 | Liu et al. | 60/286 |
| 6,464,258 | B2 * | 10/2002 | Shin | 285/49 |
| 6,601,385 | B2 | 8/2003 | Verdegan et al. | |
| 6,604,604 | B1 | 8/2003 | Badeau et al. | |
| 6,669,912 | B1 | 12/2003 | Udell | |
| 6,669,913 | B1 | 12/2003 | Haberkamp | |
| 6,712,869 | B2 | 3/2004 | Cheng et al. | |
| 6,722,123 | B2 | 4/2004 | Liu et al. | |
| 6,776,814 | B2 | 8/2004 | Badeau et al. | |
| 6,820,417 | B2 | 11/2004 | May et al. | |
| 7,052,532 | B1 | 5/2006 | Liu et al. | |
| 7,211,226 | B2 | 5/2007 | Liu et al. | |
| 2004/0093856 | A1 * | 5/2004 | Dingle et al. | 60/286 |
| 2007/0028601 | A1 * | 2/2007 | Duvinage et al. | 60/286 |
| 2007/0178025 | A1 | 8/2007 | Opris | |

* cited by examiner

*Primary Examiner* — Thomas E Denion
*Assistant Examiner* — Audrey Klasterka
(74) *Attorney, Agent, or Firm* — Andrus, Sceales, Starke & Sawall, LLP; J. Bruce Schelkopf

(57) ABSTRACT

An exhaust aftertreatment system includes first and second exhaust tubes or assemblies and a coupler compliantly permitting movement of one of the exhaust tubes relative to the other along at least one of axial and transverse directions.

4 Claims, 2 Drawing Sheets

EXHAUST AFTERTREATMENT SYSTEM WITH COMPLIANTLY COUPLED SECTIONS

BACKGROUND AND SUMMARY

The invention relates to aftertreatment systems for internal combustion engine exhaust, including diesel exhaust, and more particularly to chemical species injection, and catalysis.

To address engine emission concerns, new standards continue to be proposed for substantial reduction of various emissions, including $NO_x$ and particulate emissions. Increasingly stringent standards will require installation of aftertreatment devices in engine exhaust systems. Some of the aftertreatment technologies require certain chemical species to be injected into the exhaust system. For example, HC or fuel is injected in some active lean $NO_x$ systems, and additives such as cerium and iron are injected for diesel particulate filter regeneration, and urea solution or other reductant is injected in selective catalytic reduction (SCR) systems for $NO_x$ reduction. These injected chemical species mix with exhaust gas before reaching downstream catalysts or filters.

DETAILED DESCRIPTION

Figure 1:
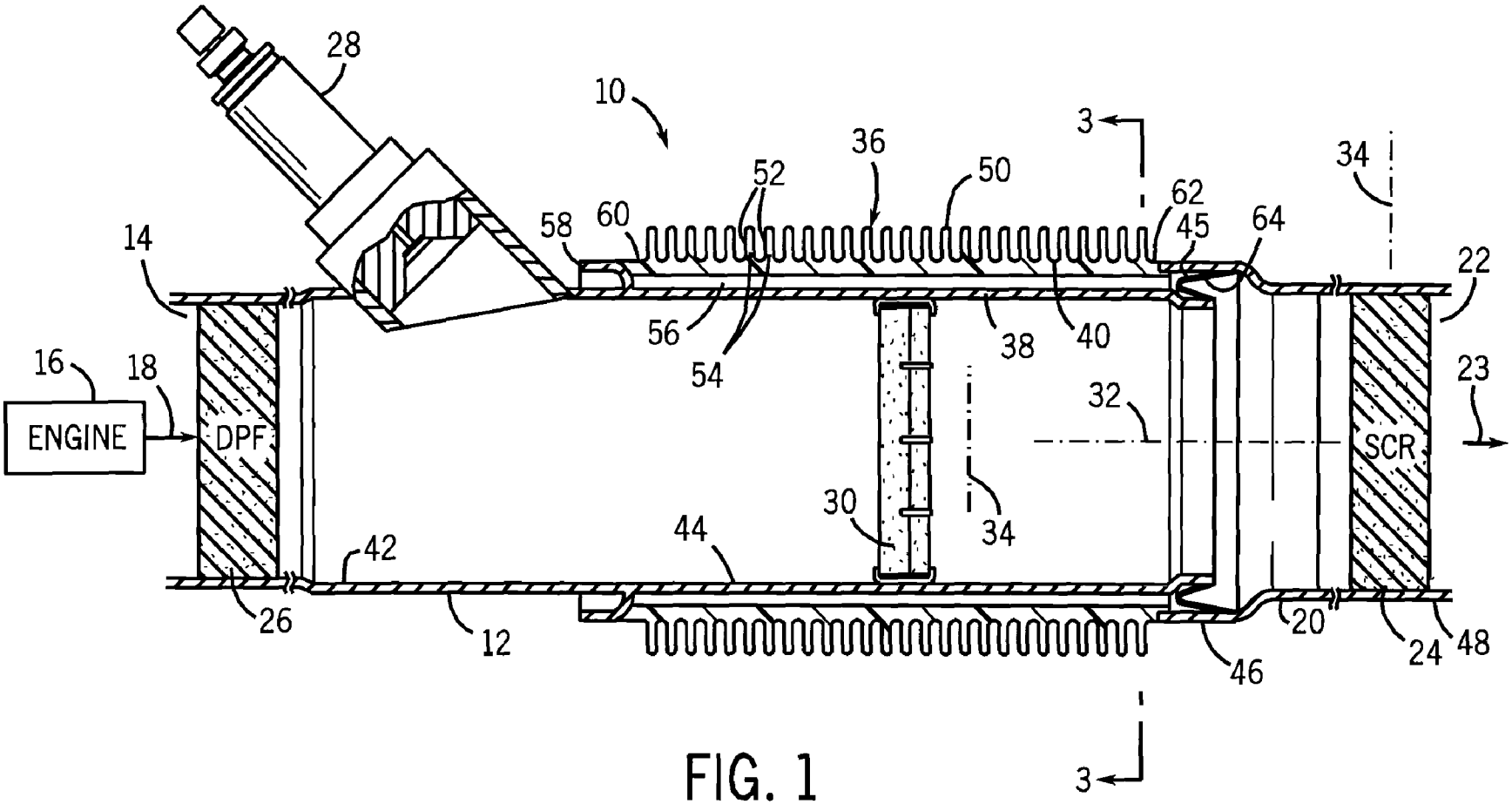
FIG. 1 is a side sectional schematic view of an exhaust aftertreatment system in accordance with the invention.
Figure 2:
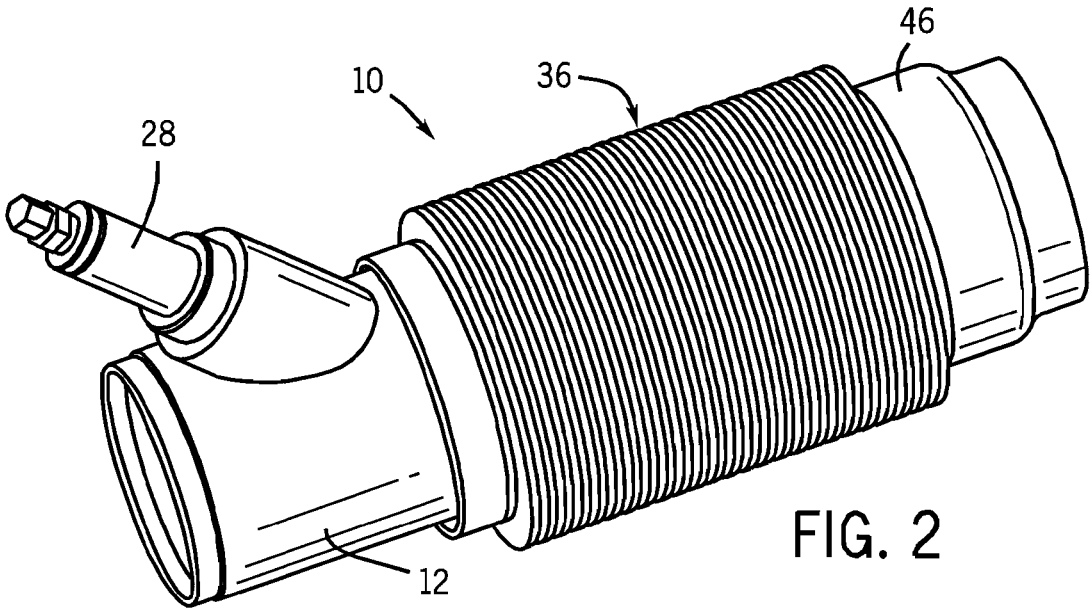
FIG. 2 is a perspective view of a portion of FIG. 1.
Figure 3:
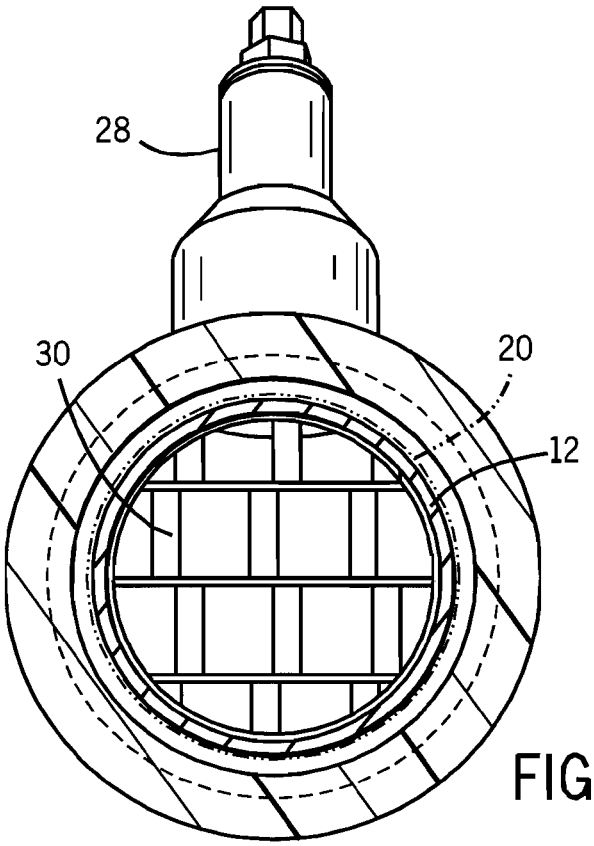
FIG. 3 is a sectional view taken along line 3-3 of FIG. 1.

The drawings show an exhaust aftertreatment system 10 including a first exhaust tube or assembly 12 having an upstream inlet 14 for receiving engine exhaust from an internal combustion engine 16 as shown at arrow 18, and a second exhaust tube or assembly 20 having a downstream outlet 22 for discharging the exhaust as shown at arrow 23. The assembly carries the exhaust to a downstream aftertreatment element 24 for treating the exhaust, for example an SCR (selective catalytic reduction) catalyst and/or a DOC (diesel oxidation catalyst) or other oxidation catalysts and/or a DPF (diesel particulate filter) or other particulate filter. In one embodiment, an SCR catalyst 24 is provided in or downstream of exhaust tube 20, and DPF 26 is provided in or upstream of exhaust tube 12, for diesel engine exhaust. Exhaust tube 12 has an injector 28 injecting chemical species into the exhaust tube and mixing with the engine exhaust prior to reaching aftertreatment element 24. For example, in one embodiment for a diesel engine 16, aqueous urea solution or other reductant is injected at injector or doser 28. The injected urea decomposes and hydrolyzes to ammonia to react with and reduce $NO_x$ in the exhaust. For further description regarding exhaust aftertreatment systems, reference is made to the following U.S. patents, incorporated herein by reference, namely U.S. Pat. Nos. 6,449,947; 6,601,385; 6,604,604; 6,712,869; 6,722,123; 7,211,226. In the preferred embodiment, a mixer 30, e.g. a deflection or turbulating grate or the like, is provided in exhaust tube 12 upstream of aftertreatment element 24 and mixing the exhaust and the injected chemical species, as is known, for example in the noted incorporated patents, for example a turbulator, impactor, flow deflector, flow diffuser, etc. It is desired that the injected chemical species be well mixed with exhaust gas before reaching aftertreatment element 24.

Downstream exhaust tube 20 carries the engine exhaust therethrough from upstream exhaust tube 12 for flow to downstream aftertreatment element 24 catalytically treating the exhaust. The exhaust flows axially along an axial flow direction 32 from upstream exhaust tube 12 to downstream exhaust tube 20. The exhaust tubes have a cross-section spanning transversely along a transverse direction 34 transverse to axial direction 32. A coupler 36 couples exhaust tubes 12 and 20 and compliantly permits movement of at least one of the exhaust tubes relative to the other exhaust tube along at least one of the noted axial and transverse directions 32 and 34. In the preferred embodiment, coupler 36 permits transverse movement of one exhaust tube relative to the other to accommodate axial misalignment of exhaust tubes 12 and 20. Further in the preferred embodiment, coupler 36 permits axial movement of one exhaust tube relative to the other to enable shortening and lengthening of the axial distance between injector 28 and aftertreatment element 24.

First and second exhaust tubes 12 and 20 have first and second sleeve sections 38 and 40, respectively, axially overlapping each other in telescopic relation, with at least one of the sleeve sections, preferably sleeve section 40, providing the noted coupler. First exhaust tube 12 includes an upstream section 42, and a downstream section 44 downstream of injector 28. Downstream section 44 provides the noted sleeve section 38. Second exhaust tube 20 includes an upstream section 46, and a downstream section 48. Upstream section 46 of second exhaust tube 20 provides the noted second sleeve section. Upstream section 46 of second exhaust tube 20 concentrically surrounds downstream section 44 of first exhaust tube 12. Upstream section 46 of second exhaust tube 20 includes flexible tubing 50 flexing in at least one of and preferably both of axial and transverse directions 32 and 34. Upstream section 46 of second exhaust tube 20 preferably is provided by bellows tubing 50 including a plurality of axially spaced annular gussets 52 defining annular cavities 54 around downstream section 44 of first exhaust tube 12. Bellows tubing 50 permits both transverse and axial movement of first and second exhaust tubes 12 and 20 relative to each other.

Flexible tubing 50 concentrically surrounds downstream section 44 of first exhaust tube 12 and defines an annular space 56 therebetween. Flexible tubing 50 has a first end 58 facing upstream (leftwardly in FIG. 1) and stationarily fixed to downstream section 44 of first exhaust tube 12, e.g. by welding at flange 60, or other mounting fixation. Flexible tubing 50 has a second end 62 facing downstream (rightwardly in FIG. 1) and stationarily fixed to second exhaust tube 20, e.g. by welding or other mounting fixation. A baffle 64 is provided between second end 62 of flexible tubing 50 and downstream end 45 of downstream section 44 of first exhaust tube 12 and deters entry of the noted chemical species into annular space 56, to protect the flexible tubing from deleterious chemical effects. In further embodiments, baffle 64 may be a gasket blocking entry of the chemical species into annular space 56, which gasket may slide along one or the other of second end 62 of flexible tubing 50 and downstream section 44 of first exhaust tube 12. In another embodiment, the baffle may be a flexible member, e.g. folding or otherwise flexing or the like, to accommodate transverse and/or axial movement of first and second exhaust tubes 12 and 20 relative to each other while maintaining a seal therebetween or at least deterring entry of the noted chemical species into annular space 56.

Flexible tubing 50 compliantly connects first and second exhaust tubes 12 and 20. Downstream section 44 of first exhaust tube 12 at sleeve section 38 provides a liner extending along and protecting flexible tubing 50 from the noted chemical species injected from injector 28. Flexible tubing 50 and liner 38 overlap in telescoping relation and define annular space 56 therebetween. Baffle 64 between flexible tubing 50 and liner 38 deters entry of the noted chemical species into annular space 56.

The noted liner and baffle combination is significant in minimizing the deleterious effects of urea crystallization in flexible tubing, which would otherwise occur if exhaust tubes or assemblies were merely connected with flexible tubing extending serially therebetween. The latter type arrangement allows direct contact of urea with the convolutions or gussets of the flexible tubing and the cavities therein. The internal liner at sleeve section 38 protects the gussets 52 and cavities 54 of the flexible tubing, and a thin metal baffle 64 or the like deters urea from migrating backwards (leftwardly in FIG. 1) into annular space 56 and cavities 54 of gussets or convolutions 52. Liner 38 and baffle 64 thus cooperate to avoid or at least significantly reduce urea crystal build-up in the cavities 54 and convolutions or gussets 52, and still allow flexible tubing 50 to accommodate axial misalignment between exhaust tubes or assemblies 12 and 20 and enable lengthening or shortening of the axial distance between injector 28 and catalyst 24. The noted axial shortening may be particularly desirable in implementations having packaging or space constraints and also enables optimization of the smallest successful axial length combination.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. An exhaust aftertreatment system treating engine exhaust, comprising a first exhaust tube carrying said exhaust therethrough and having an injector injecting chemical species into said first exhaust tube and mixing with said exhaust, a second exhaust tube carrying said exhaust therethrough from said first exhaust tube for flow to a downstream aftertreatment element catalytically treating said exhaust, flexible tubing compliantly connecting said first and second exhaust tubes, and a liner extending along and protecting said flexible tubing from said chemical species, wherein:

said first exhaust tube comprises an upstream section, and a downstream section downstream of said injector;

said second exhaust tube comprises an upstream section, and a downstream section;

said upstream section of said second exhaust tube comprises said flexible tubing;

said downstream section of said first exhaust tube comprises said liner;

said flexible tubing and said liner overlap in telescoping relation and define an annular space therebetween, and comprising a baffle between said flexible tubing and said liner and deterring entry of said chemical species into said annular space.

2. A diesel exhaust aftertreatment system treating diesel engine exhaust, comprising a DPF (diesel particulate filter) assembly carrying said diesel exhaust therethrough and having an injector injecting reductant into said DPF assembly and mixing with said diesel exhaust, an SCR (selective catalytic reduction) assembly carrying said diesel exhaust therethrough from said DPF assembly and having an SCR catalyst treating said diesel exhaust, flexible tubing compliantly connecting said DPF and SCR assemblies, and a liner extending along and protecting said flexible tubing from said reductant, said DPF assembly comprising an upstream section, and a downstream section downstream of said injector, said SCR assembly comprising an upstream section upstream of said SCR catalyst, and a downstream section, said upstream section of said SCR assembly comprising said flexible tubing, said downstream section of said DPF assembly comprising said liner, said flexible tubing and said liner overlapping in telescoping relation and defining an annular space therebetween, and a baffle between said flexible tubing and said liner and deterring entry of said reductant into said annular space.

3. An exhaust aftertreatment system treating engine exhaust, comprising a first exhaust tube carrying said exhaust therethrough and having an injector injecting chemical species into said first exhaust tube and mixing with said exhaust, a second exhaust tube carrying said exhaust therethrough from said first exhaust tube for flow to a downstream aftertreatment element catalytically treating said exhaust, said exhaust flowing axially along an axial flow direction from said first exhaust tube to said second exhaust tube, said exhaust tubes having a cross-section spanning transversely along a transverse direction transverse to said axial direction, a coupler coupling said first and second exhaust tubes and compliantly permitting movement of one of said exhaust tubes relative to the other of said exhaust tubes along at least one of said axial and transverse directions, wherein:

said first and second exhaust tubes comprise first and second sleeve sections, respectively, axially overlapping each other in telescopic relation, at least one of said sleeve sections providing said coupler;

said first exhaust tube comprises an upstream section, and a downstream section downstream of said injector, said downstream section comprising said first sleeve section;

said second exhaust tube comprises an upstream section, and a downstream section, said upstream section of said second exhaust tube comprising said second sleeve section;

said upstream section of said second exhaust tube concentrically surrounds said downstream section of said first exhaust tube;

said upstream section of said second exhaust tube comprises flexible tubing flexing in at least one of said axial and transverse directions;

said flexible tubing concentrically surrounds said downstream section of said first exhaust tube and defines an annular space therebetween;

said flexible tubing has a first end facing upstream and stationarily fixed to said downstream section of said first exhaust tube;

said flexible tubing has second end facing downstream;

and comprising a baffle between said second end of said flexible tubing and said downstream section of said first exhaust tube and deterring entry of said chemical species into said annular space;

said baffle comprises a gasket blocking entry of said chemical species into said annular space.

4. The exhaust aftertreatment system according to claim 3 wherein said gasket is slidable along at least one of said second end of said flexible tubing and said downstream section of said first exhaust tube.

* * * * *